US005144704A

United States Patent [19]

Genzel et al.

[11] Patent Number: 5,144,704

[45] Date of Patent: Sep. 8, 1992

[54] SWIMMING POOL COVER WITH MULTIPLE AIR COMPARTMENTS

[76] Inventors: Charles C. J. Genzel; Linda Genzel, both of 108 Geymer Dr., Mohopac, N.Y. 10541

[21] Appl. No.: 607,885

[22] Filed: Nov. 1, 1990

[51] Int. Cl.[5] ..... E04H 4/00

[52] U.S. Cl. ..... 4/499; 4/498; 4/503; 4/513

[58] Field of Search ..... 4/498, 499, 503, 513

[56] References Cited

U.S. PATENT DOCUMENTS

| | | | |
|---|---|---|---|
| 3,063,062 | 11/1962 | Logan | 4/499 |
| 3,072,920 | 1/1963 | Yellott | 4/498 |
| 3,184,763 | 5/1965 | Kennedy | 4/499 |
| 3,533,110 | 10/1970 | Gisondi | 4/172.12 |
| 3,676,880 | 7/1972 | Kwake | 4/172.12 |
| 3,747,131 | 7/1973 | Koliomichalis | 4/172.12 |
| 3,801,994 | 4/1974 | Brown | 4/172.12 |
| 3,871,033 | 3/1975 | Barttett | 4/499 |
| 4,000,527 | 1/1977 | Gannon | 4/499 |
| 4,000,749 | 1/1977 | Busco | 4/498 |
| 4,048,678 | 9/1977 | Chillino | 4/172.12 |
| 4,577,352 | 3/1986 | Gautheron | 4/499 |
| 4,606,083 | 8/1986 | Kingston | 4/580 |
| 4,685,254 | 8/1987 | Terreri | 52/2 |
| 4,953,239 | 9/1990 | Gadsby | 4/499 |

FOREIGN PATENT DOCUMENTS

| | | | |
|---|---|---|---|
| 2234585 | 1/1974 | Fed. Rep. of Germany | 4/499 |
| 2440458 | 3/1976 | Fed. Rep. of Germany | 4/499 |
| 2544213 | 10/1984 | France | 4/498 |
| 2561699 | 9/1985 | France | 4/498 |

*Primary Examiner*—Henry J. Recla
*Assistant Examiner*—Keith Kupferschmid

[57] ABSTRACT

This pool cover utilizes multiple, laterally displaced air compartments which are fixed in location with respect to each other, and are integral portions of the cover. The air compartments may be interleaved by having laterally overlapping portions in order to minimize sagging which may result if any air compartment were to have an air leak. The cover can include a removable exterior portion which is exposed, and an interior portion containing the air compartments which are in contact with the pool surface. This allows easy removal of the top portion of the cover for cleaning and for examining individual air compartments.

17 Claims, 3 Drawing Sheets

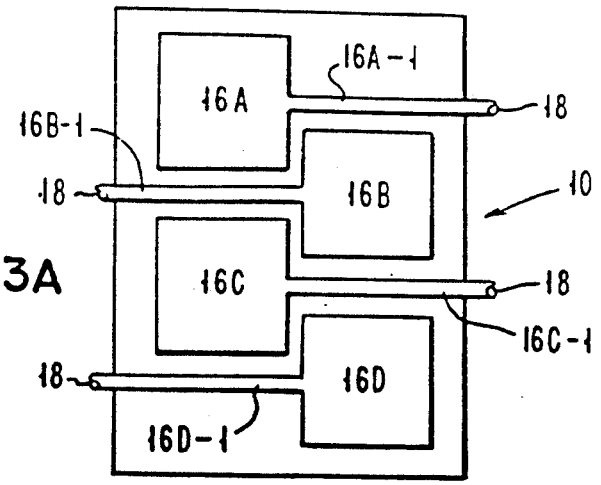
FIG. 3A
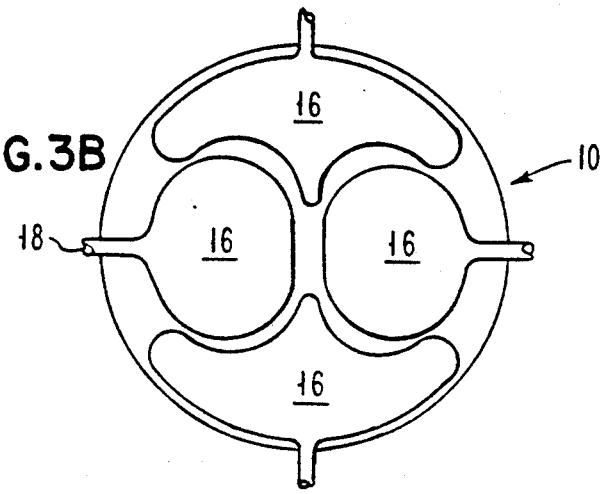
FIG.3B
FIG. 4A
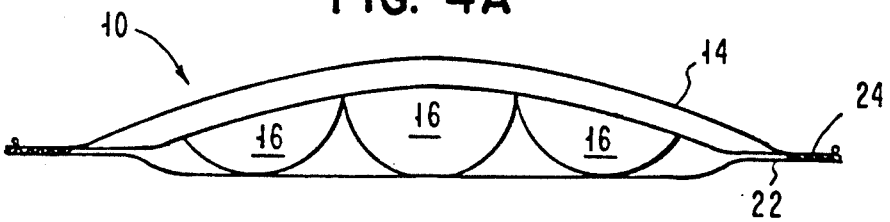
FIG. 4B
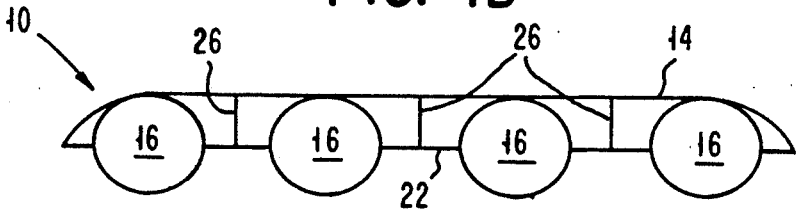

SWIMMING POOL COVER WITH MULTIPLE AIR COMPARTMENTS

DESCRIPTION

1. Field of the Invention

This invention relates to an improved swimming pool cover, and more particularly to such a cover employing multiple air compartments, the cover being non-sagging throughout and suitable for use with both in-ground and above-ground pools.

2. Background Art

Swimming pool covers are well known and various designs have been proposed, many of which utilize a single air compartment to provide a convex shape above the pool. When the air compartment is inflated, the pool cover will be bowed outwardly so as to provide a crown for shedding debris, etc. which would collect on the pool cover. In turn, this prevents sagging of the cover and, hopefully, debris will not enter the pool.

One particularly well known technique for covering pools and which is commercially marketed utilizes multiple "pillows" which are manufactured and sold in separate sizes. These pillows are placed on the water surface, and the pool cover is then positioned over the pillows. The pillows can be fastened to the edges of the pool and, when inflated, will lift the cover to achieve the desired bowed shape. While it is preferable to use only a single large pillow in the center of the pool for support of the cover in the proper shape, it is often found that several pool pillows are required. A major problem with this approach is that it is difficult to position the pillows on the surface of water and the pillows tend to shift position, even though they are fastened to the sides of the pool. Any shifting of pillows will cause a dip in the pool cover onto which debris, water, etc. will collect, further shifting the pillows and creating even larger dips in the pool cover.

Other problems with the cover-pillow combination are that the pillows are not easily stored when not in use and tend to have to be replaced regularly. Also, it takes a considerable amount of time to locate and fasten the pillows prior to placing the cover across the pillows in a manner in which the pillows and cover are displaced in the proper relative positions.

In addition to the technique described hereinabove, various swimming pool cover designs have been patented. For example, U.S. Pat. No. 4,685,254 describes a design in which a single air balloon is used to elevate the center of a separate cover in order to cover an above-ground pool. It is difficult to position the balloon and to secure it prior to placing it over the pool. This design also does not guarantee that the cover will not sag at various points and in particular this design is difficult to utilize for large area pools.

Other designs using single air compartments are represented by U.S. Pat. Nos. 3,676,880 and 3,801,994. In '880, a complex design is described which allows a person to enter the enclosure formed by the domed cover. While this design is intended to provide a cover that is in place while the pool is being used, it is very complex and difficult to assemble. '994 describes a cover in which air is bubbled up through the pool to lift the cover, there being a weight to hold a portion of the cover below the water surface. In one embodiment, a double bag having one air bag within another (i.e., not laterally displaced air compartments) is used. This is a rather complex structure involving many components and is not particularly suitable for easy installation by a single individual. In addition, the design is very expensive and would be prohibitive for home use.

Additional designs using a single air compartment are represented by U.S. Pat. Nos. 3,533,110 and 4,606,083. In addition, various techniques of securing the pool cover to the edge of the pool or to the frame surrounding the pool are shown in U.S. Pat. Nos. 3,747,131 and 4,048,678. Again, these covers utilize a single air compartment.

While the prior art shows numerous covers utilizing an air-filled compartment for providing a crowned shape of the cover, this art does not address all the problems confronting the pool owner. For example, these techniques are not simple and easy to use, and don't ensure that sagging would not develop when the cover is in place over the pool for long intervals of time. Accordingly, it is an object of the present invention to provide an improved pool cover utilizing multiple, laterally displaced air compartments in order to provide a cover which will maintain a non-sagging shape even though it is in place for an extended period of time.

It is another object of the present invention to provide an improved pool cover which is of simple design and lightweight, and which is easy to use.

It is another object of the present invention to provide an improved pool cover which can be installed and removed by a single person without undue effort or discomfort, and which is foldable to allow easy and compact storage.

It is another object to provide an improved pool cover which will resist sagging even though partial loss of air may occur.

It is still another object of the present invention to provide an improved pool cover which can be used with both above-ground and in-ground swimming pools, and which can be readily utilized with pools of varying shape and size.

BRIEF SUMMARY OF THE INVENTION

This invention is a simple and lightweight pool cover which utilizes multiple, laterally displaced air compartments which are individually inflatable and which can be shaped in accordance with the shape of the pool to be covered. For example, for a round pool the air compartments can extend radially outward from the center of the pool. In another particularly advantageous embodiment, the air compartments are interleaved so that, if an air leak occurs in any compartment, the interleaved adjacent air compartments will help to prevent any localized sagging.

In one embodiment, the air compartments are located in contact with the cover, while in another embodiment the air compartments can be separated from the cover being attached thereto by means such as a zipper.

The pool cover can be fastened to the pool edges or to the area surrounding the pool by conventional means, such as grommets, weights, weighted sleeves, etc.

The use of multiple, laterally displaced air compartments insures that the pool cover will have a uniform crown and that the shape of the crown will be maintained for long periods of time without the shifting of air compartments which normally leads to sagging and without the excessive sagging that occurs if any type of air leak develops. Further, the stitching that can be used to attach the air compartments to the cover can be along tabs located below the cover so that even the stitching is not exposed on the top surface of the cover. This will provide an extremely smooth cover which also aids in the shedding of debris from the pool cover.

These and other objects, features and advantages will be apparent from the following, more particular description of the preferred embodiments.

BRIEF DESCRIPTION OF THE DRAWINGS

FIG. 2A illustrates radial air compartments in a round cover. FIG. 2B illustrates rectangular air compartments in a rectangular or square cover, and FIG. 2C illustrates different shaped air compartments for use with a cover for a kidney-shaped pool.

FIG. 3A illustrates the use of laterally displaced, interleaved air compartments suitable for use with a square or rectangular cover, while FIG. 3B illustrates interleaved air compartments for use with a round pool cover.

FIG. 4A illustrates a pool cover in which the laterally displaced air compartments are part of a separate attachable liner where the exposed cover is removable, while FIG. 4B illustrates the use of tabs or other means to secure the laterally displaced air compartments on the underside of the pool cover in a manner to avoid exposed stitching on the surface of the pool cover.

DESCRIPTION OF THE PREFERRED EMBODIMENTS

Figure 1:
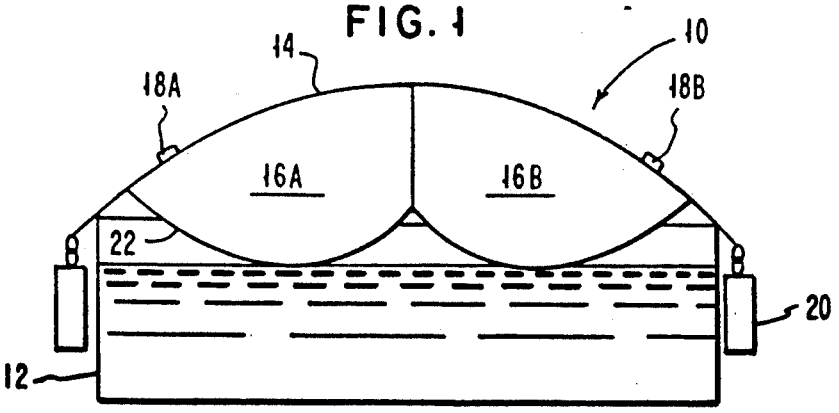
FIG. 1 schematically illustrates a pool having a cover thereover utilizing multiple, laterally displaced air compartments.

FIG. 1 shows the use of the pool cover 10 of the present invention to cover a pool 12, which could be either an in-ground pool or an above-ground pool. Cover 10 includes an exposed top surface 14 and air compartments 16A, 16B, etc. Although in FIG. 1 only two air compartments are shown in this view, it should be understood that multiple, laterally displaced air compartments can be utilized, the number and shape of the laterally displaced air compartments being determined in accordance with the size of the pool and its shape. Inflation ports 18A and 18B, such as valves, are provided for inflating compartments 16A and 16B, respectively. Pool cover 10 is held at its outer edges against the edge of the pool by, in this illustration, weights 20. If desired, various well known clamps or grommets can be used to fasten the outer edges of the pool cover to the pool body, or to the surrounding deck or the ground.

Air compartments 16A and 16B can be filled in known ways, including air hoses (for example, attached to the exhaust port of a vacuum cleaner), or by $CO_2$ cartridges. Further, air pumps or compressors can be used to fill the air compartments. A screw-type valve attached to the inflation ports 18A and 18B is preferred, as this type of valve would minimize air leakage through the inlet/outlet ports 18.

The use of multiple air compartments provides the proper convex or crowned shape over the pool, and also prevents sagging and the attendant collection of debris which would result if sagging occurred. In this embodiment, the double layered cover 10 is preferably made of a durable, light and flexible material, such as nylon TM or other compositions. It is preferable that the cover material is such that the entire cover can be folded for ease of storage and for application and removal from the pool. Additionally, the exterior (exposed) portion 14 of cover 10 should be smooth to allow debris to slide easily off it. The interior portion 22, defining the air compartments 16A, 16B, . . . should be of a durable rubbery material which can hold large quantities of air. Suitable materials are well known in the art.

Figure 2C:
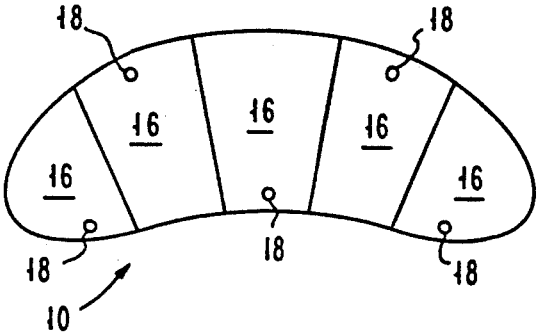
FIGS. 2A, 2B, and 2C illustrate pool covers having different shaped air compartments depending upon the shape of the pool to be covered.
Figure 2A:
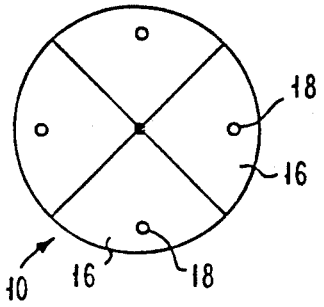
Figure 2B:
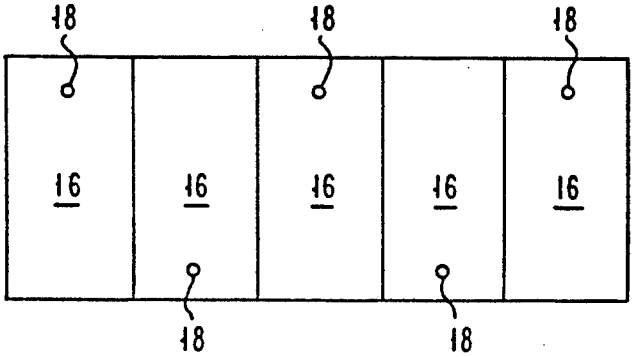

FIGS. 2A–2C are top views of pool covers showing various shaped air compartments and the location of the inlet/outlet ports used to fill and remove air from the compartments. The same reference numerals will be used as were used in FIG. 1, for components having the same function. Accordingly, FIG. 2A shows a cover 10 having a plurality of laterally displaced, radial air compartments 16, each of which has associated therewith an inlet/outlet port 18.

In FIG. 2B, a rectangular shaped pool cover 10 includes a plurality of laterally displaced, rectangular shaped air compartments 16, each of which has an inlet/outlet port 18. In this cover, the ports 18 are staggered with respect to one another and are located on both longitudinal edges of the cover. For ease of filling, it may be desirable to have all ports 18 located on the same side of the cover 10.

In FIG. 2C, cover 10 is used to enclose a kidney-shaped pool and includes laterally displaced air compartments 16 which are of varying shape, depending upon their location along the cover. Inlet/outlet ports 18 are provided for each air compartment. In this cover, the particular shape of any compartment is chosen in accordance with its location in the cover. For example, it is usually desirable to have a larger air compartment in the center of the cover, where the cover is lifted to a maximum height from the pool surface. As an alternative, the central compartment can be a plurality of smaller, individually filled compartments order to minimize sagging at the center of the cover, if a leak developed there.

FIGS. 3A and 3B illustrate the use of laterally displaced air compartments which are interleaved with one another in an overlapping fashion in order to minimize sagging effects which would occur if a leak developed in any individual compartment. In FIG. 3A, generally rectangular-shaped air compartments 16A, 16B, 16C, and 16D are shown for use in, for example, a rectangular or square cover 10. Each air compartment has a narrower portion 16A-1, 16B-1, 16C-1, and 16D-1 to which an inlet/output port 18 is attached for filling and removing air from the compartments. In this embodiment, the ports 18 are located on opposite edges of the pool cover for alternately displaced air compartments.

In the embodiment of FIG. 3A, sagging is minimized if a leak develops in an air compartment, due to the overlapping nature of the adjacent air compartments. For example, if a leak developed in compartment 16B, overlapping adjacent compartments 16A and 16C would help to minimize the effect of sagging. Of course, it is understood that the degree of overlapping can be extended beyond that shown in FIG. 3A to greater ensure minimization of sagging. For example, a honeycomb or two interleaving comb-like arrays of air compartments can be utilized.

FIG. 3B illustrates the concept of interleaved air compartments 16 in a round pool cover 10. Air compartments 16 have inlet/outlet ports 18 associated therewith arranged around the periphery of the pool cover in order to allow easy access thereto. Again, the exact shape and size of any air compartment can be designed to make it most suitable for its location within the pool cover. For example, the crown shape which is desired for the pool cover when it's in operation may require larger size air compartments at the center of the cover and smaller size compartments along the edges of the cover. Within this guideline, the geometry of an individual compartment can be varied.

FIGS. 4A and 4B illustrate different arrangements for removable pool covers, where the exposed exterior portion 14 of the cover can be detached. In FIG. 4A, the exterior cover 14 is fastened to the interior liner 22 along the edges of the exterior portion and the liner, as by a zipper 24. Interior portion 22 encloses the air compartments 16. In this embodiment, the interior portion 22 can be located on the water surface and the air compartments completely filled prior to locating and fastening the exterior portion 14. This allows one to determine that the air compartments 16 are properly filled and to test for leaks prior to applying the exterior exposed portion 14. Still further, if during use any leaks develop, the exterior portion 14 can be removed to get rid of any debris that may have accumulated due to these leaks. Rather than releasing air from all the compartments and having to contend with a larger and more heavy mass, other removable exterior portion 14 is easily removed and cleaned. Since, in the course of winter it is likely that some air loss may occur from the compartments, such an embodiment may prove to be very desirable.

In FIG. 4B, the cover 10 includes an exterior portion 14 and an interior portion 22 containing the air compartment 16. Tabs 26 are used to fasten the exterior portion 14 and interior portion 22. If desired, snaps or zippers can be used along the tabs 26 so that top portion 14 can be separated from interior portion 22. Such a detachable means would be useable for storage of the cover when it is not in use. The removal of exterior portion 14 from interior portion 22, during use, is much more convenient with the edge-fastening arrangement 24 shown in FIG. 4A.

Figure 5A:
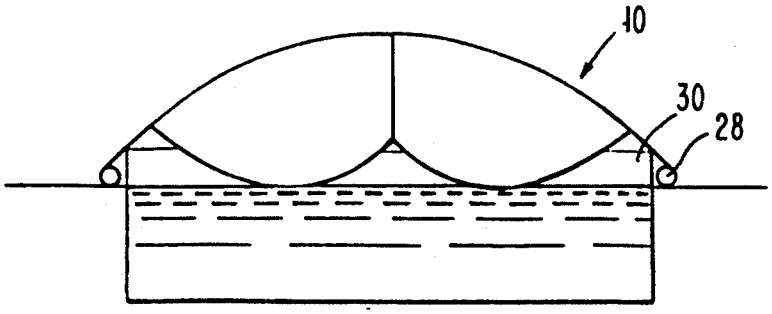
FIGS. 5A–5C schematically illustrate different types of pool cover fastening, FIG. 5A illustrating the use of a water-filled sleeve, FIG. 5B illustrating the use of grommets, and FIG. 5C illustrating the use of weights.
Figure 5B:
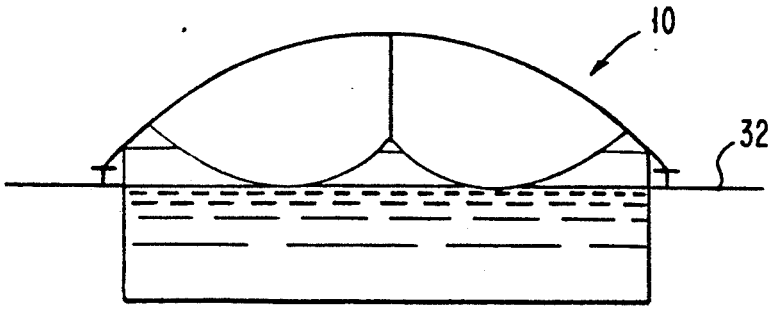
Figure 5C:
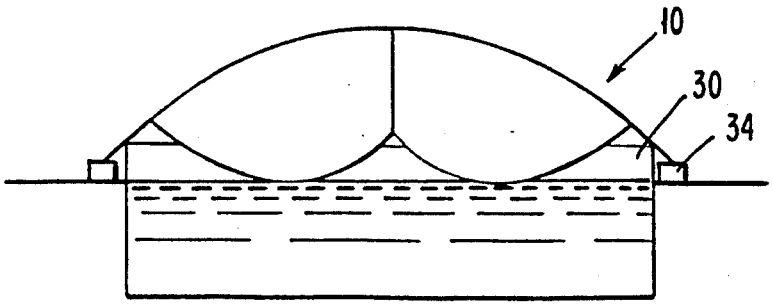

FIGS. 5A–5C illustrate various means for attaching the pool cover 10 to the sides of the pool, to an adjoining deck, or to the ground. In FIG. 5A, a water-filled sleeve 28 fits over the edge 30 of the pool and provides sufficient weight to hold cover 10 in contact with the edges 30 of the pool. In FIG. 5B, grommets are used to attach a pool cover 10 to a deck or other supporting structure 32. In FIG. 5C, weights 34 are used to secure the cover 10 to the pool edges 30. In addition to these well-known means, other techniques such as clamps, can be utilized. The exact manner in which the pool cover 10 is attached to the sides of the pool or the surrounding structure or ground is not a critical feature of the present invention, and any of the well-known means can be utilized.

In the practice of this invention, a lightweight pool cover of simple design has been described, which is reliable and easy to use. The cover is distinguished by a plurality of laterally air compartments whose shape and size can be tailored in accordance with the size and shape of the pool cover. Further, the air compartments can be made in an interleaved fashion so as to minimize the likelihood of sagging if there is any air leak.

While the invention has been described with respect to several embodiments, it will be apparent to those of skill in the art that variations can be made therein without departing from the spirit and scope of the present invention. For example, air compartments of different shapes and covers of different shapes than those shown herein can be visualized. Further, the types of removable covers and the techniques for providing such removable covers can be numerous even though the principles with respect to FIGS. 4A and 4B are utilized. The multiple laterally displaced air compartments of this pool cover are fixed with respect to one another and are an integral portion of the overall pool cover. This provides ease of use and air compartments which will not become movable when the pool cover is in use, in order to insure the proper crown-shaped contour of the cover.

We claim:

1. An inflatable cover adapted to be used to cover a swimming pool having an arbitrary shape and size at the water surface thereof, said cover including:

a continuous surface sheet which extends at least to all edges of a pool to be covered, the entire surface sheet being above the pool surface, at least two inflatable endosed compartments defined by lower sheet means attached to said surface sheet for raising said surface sheet to a generally domed shape when said compartments are inflated, said compartments being laterally displaced from one another in the direction of the pool surface and being an integral portion of said surface sheet, air or gas inlet means attached to each said inflatable compartment independently inflating said compartments, and holding means attached to said sheet along the edges thereof for holding the entire cover in a substantially fixed position when said cover is positioned over said pool wherein said sheet and said inflatable compartments rest above the water surface of said pool when said compartments are inflated, there being no portions of said sheet which rest below said water surface.

2. The cover of claim 1, where said inflatable compartments laterally overlap or interleave with one another.

3. The cover of said claim 1, where said inflatable air compartments are shaped in accordance with the geometry of said pool.

4. The cover of claim 1, where the top surface of said cover is smooth.

5. The cover of claim 4, where said air compartments are sewn together, the stitching for said air compartments being located below said continuous surface sheet.

6. The cover of claim 1, where said inflatable compartments are fixed in location with respect to one another and are permanently attached to said cover.

7. The cover of claim 6, where said inlet means for inflating each compartment are located at the edges of said pool cover.

8. The cover of claim 1, where said cover is foldable when said air compartments are deflated.

9. An inflatable cover adapted for use in covering a swimming pool, including, said cover having an exterior portion which is exposed to the weather when said cover is placed over a pool, said cover having an interior portion attached to said exterior portion to define a plurality of laterally displaced inflatable compartments in the direction of said pool surface, a liner attached to peripheral edges of said cover and extending across said cover below said compartments, an air or gas inlet/outlet means attached to each inflatable compartment for independently inflating each compartment, said inlet/outlet means being located along the edge of said cover, and holding means for holding said pool cover in a substantially fixed location over said pool in a manner to ensure that both the exterior and interior portion of said cover, including said liner, are above the water surface of said pool.

10. The cover of claim 9, where said inflatable compartments are interleaved laterally with one another, there being laterally inter-leaved portions of adjacent inflatable compartments.

11. The pool cover of claim 9, where said cover is generally round and said inflatable compartments are pie-shaped and extend radially outward from the center of said cover.

12. The pool cover of claim 9, where said cover is generally square or rectangular and said inflatable compartments are substantially rectangular.

13. The pool cover of claim 9, where said exterior portion includes means for detachably fastening it to said interior portion.

14. A cover adapted for use in covering a swimming pool, including:

a continuous sheet of an area larger than the lateral area of the surface of the water contained in said swimming pool, said continuous sheet being exposed to the weather when said cover is placed over said swimming pool, a plurality of interleaved inflatable compartments extending in lateral directions substantially parallel to the water surface and located between said continuous sheet and the surface of the water in said pool, wherein each said inflatable air compartment has at least one lateral edge thereof which undulates and laterally interleaves with an undulating lateral edge of an adjacent inflatable compartment thereby producing adjacent inflatable compartments which interleave and extend into one another in a lateral direction along the surface of the water in said swimming pool, air or gas inlet means for inflating each of said interleaved inflatable compartments, and holding means for holding the entire swimming pool cover in place above said pool, both said continuous sheet and said inflatable compartments being located above the surface of the water contained in said pool when said interleaved compartments are inflated and said cover is held in place over said pool.

15. The cover of claim 14, where each of said inflatable compartments has an irregular lateral shape including at least one wider lateral portion and at least one more narrow lateral portion, the wide portion of any inflatable compartment being adjacent to a narrow portion of a laterally adjacent inflatable compartment.

16. The cover of claim 14, where adjacent interleaved inflatable compartments have different shapes viewed laterally in a plane substantially parallel to the plane of the water surface.

17. The cover of claim 14, where said inflatable compartments are portions of a liner capable of being detached and refastened to said continuous sheet and which rests on the surface of said water when said cover is in place over said pool.

* * * * *